United States Patent [19]

Geanous et al.

[11] Patent Number: 4,734,625

[45] Date of Patent: Mar. 29, 1988

[54] CONTROL CIRCUIT FOR SYSTEM FOR CONTROLLING THE OPERATION OF ELECTRIC LIGHTS

[75] Inventors: Michael Geanous; Richard G. Confer, both of Erie, Pa.

[73] Assignee: American Sterilizer Company, Erie, Pa.

[21] Appl. No.: 662,231

[22] Filed: Oct. 18, 1984

[51] Int. Cl.[4] ..... H05B 37/00

[52] U.S. Cl. ..... 315/313; 315/90; 315/312

[58] Field of Search ..... 315/88, 90, 313, 322, 315/362, 130, 131, 153, 294, 312

[56] References Cited

U.S. PATENT DOCUMENTS

| | | | |
|---|---|---|---|
| 3,678,286 | 7/1972 | Willis | 315/90 X |
| 3,790,846 | 2/1974 | Morris | 315/88 X |
| 3,883,777 | 5/1975 | Morita | 315/88 |
| 4,034,259 | 7/1977 | Schoch | 315/90 X |
| 4,068,216 | 1/1978 | Brouwer et al. | 315/130 X |
| 4,227,119 | 10/1980 | Murata et al. | 315/153 X |
| 4,250,432 | 2/1981 | Kohler | 315/362 X |
| 4,288,844 | 9/1981 | Fisher et al. | 362/3 X |
| 4,458,179 | 7/1984 | Bainbridge et al. | 315/313 X |
| 4,461,974 | 7/1984 | Chiu | 315/88 X |
| 4,550,176 | 10/1985 | Callahan et al. | 315/294 |

*Primary Examiner*—David K. Moore

*Attorney, Agent, or Firm*—Kirkpatrick & Lockhart

[57] ABSTRACT

A preferred control circuit is adapted particularly for use in a system that controls the operation of at least a pair of light sources. The system permits switching, at a controller remote from the light head which contains the light sources, energizing power from an energized light source to a de-energized light source. The circuit monitors the integrity of the energized light source and switches energizing power from the energized light source to the de-energized light source when the energized light source fails. The circuit monitors the integrity of the de-energized light source and energizes a failed filament indicator when the de-energized light source fails.

4 Claims, 3 Drawing Figures

CONTROL CIRCUIT FOR SYSTEM FOR CONTROLLING THE OPERATION OF ELECTRIC LIGHTS

BACKGROUND OF THE INVENTION

1. Field of the Invention

The present invention relates to electrical lighting and, in particular, to circuits for operating electric lights.

2. Description of the Prior Art

Continuous maintainance of proper illumination is critical to the effective performance of surgical procedures. To ensure that illumination having an appropriate pattern is available during the performance of the procedure, surgical lights are often employed which are capable of providing two or more illumination patterns. The surgical lights include light sources which are energized either individually or together in any one of at least two combinations to make available more than one illumination pattern. Often, the surgical light is provided with different types of light sources each of which can produce a different light pattern. Each source can be either one of several different types of lamps or one filament of a lamp having multiple filaments. Accordingly, switching energizing power between lamps or filaments changes the illumination pattern provided by the light.

Usually, the surgical light includes a lighting control system which permits manual switching of energizing power among the light sources of the light to change the illumination pattern created by the light. Further, many surgical lights reduce the risk of loss of illumination during performance of a surgical procedure by including in the surgical light a lighting control system which permits manual switching of energizing power from a failed source—a source which no longer provides adequate illumination—to a backup source, which may be one of the sources which provides an illumination pattern different from those provided by the energized sources and by the failed source.

Requiring manual switching of energizing power from a failed light source to an operable source presents the obvious disadvantage of temporary loss of adequate illumination between the times of failure of the failed source and energization of the backup source.

Conventional surgical lights require manual actuation of a switch at the light head, the housing which contains and supports the light sources of the surgical light, to switch energizing power among light sources and achieve a change in the illumination pattern. If a person other than one of the members of the normal surgical team is provided to operate the surgical light at the light head, the already congested surgical area becomes more congested. If a member of the normal surgical team is assigned the duty of operating the surgical light, that member's attention is periodically diverted from that member's normal duties to operate the light, with the possible degradation of overall performance by that member. Therefore, it would appear to be desirable to permit manual switching of energizing power from one source to another by providing a controller mounted at a location remote from the light head to permit its operation by a person other than a member of the normal surgical team and without adding to the congestion of the surgical area. To applicant's knowledge, with one exception, a lighting control system having such a remotely mounted controller has not been provided due to the complexity involved in providing the system with the capability of switching energizing power among light sources using an acceptably low number of electrical conductors between the remote controller and the light head. The exception is the system described in Application for U.S. Letters Patent Ser. No. 362,117, filed Mar. 26, 1982, and owned by the assignee of the present application, which switches energizing power from one light source to another by reversing the polarity of the voltage applied by the controller to the light head of the surgical lamp.

Therefore, there exists a need for a circuit which automatically switches energizing power among light sources when adequate illumination is lost. There exists a further need for a circuit which automatically de-energizes a failed light source and energizes an operable source upon failure of the failed source. There exists a further need for a circuit which monitors the operability of a backup light source and provides an indication that a backup source has failed to ensure that a backup source is available upon failure of an energized source. Further, there is a need for a circuit which permits provision of a lighting control system having a controller mounted at a location remote from the light head of a surgical light which communicates with the light head over only two electrical conductors, without requiring a reversal of the voltage applied to the light by the controller.

SUMMARY OF THE INVENTION

The present invention can be used to operate any electric light that can create at least two illumination patterns and that changes the illumination pattern it produces by switching energizing power among light sources or groups of light sources.

The present invention provides a circuit adapted to control the operation of at least two sources of visible light. The control circuit includes a first switch associated with a first light source and a second switch associated with a second light source. Each switch is adapted for connection to energizing power suitable for igniting the light sources and is adapted to operate in at least two states. The switch applies energizing power received by it to a light source when the switch is in a first state and prevents application of energizing power to the light source when the switch is in a second state. The switch defines an input adapted to receive control signals. The switch is in its first state when a control signal of a first type is applied to the input and the switch is in its second state when a control signal of a second type is applied to the input. The control circuit includes a circuit for generating the control signals. The control signal generating circuit defines a first output which is operably associated with the first switch and a second output which is operably associated with the second switch. The control signal generating circuit is adapted to generate the control signals at the outputs to apply the control signals to the switches. The control signal generating circuit is in a first state when the first control signal is available at the first output and the second control signal is available at the second output. The control signal generating circuit is in a second state when the first control signal is available at the second output and the second control signal is available at the first output. The control signal generating circuit defines a switch input. The control signal generating circuit changes the states of its outputs each time a switch signal is applied to the switch input. The control circuit includes a circuit that applies switch signals to the switch input of the control signal generating circuit.

In one embodiment of the present invention, a switch signal is applied to the switch input each time the level of the energizing power drops below a predetermined level for a predetermined period of time. In a further embodiment of the present invention, the circuit which applies the switch signals to the switch input of the control signal generating circuit does so when an energized light source fails. In a further embodiment of the present invention, the circuit which applies switch signals to the switch input of the control signal generating circuit does so each time a de-energized light source fails.

The present invention provides a further circuit adapted to operate at least two sources of visible light. The circuit includes a control circuit for receiving electrical energizing power suitable for igniting the light sources and selectively energizing and de-energizing the light sources. The control circuit is in a first state when the circuit energizes a first light source and does not energize a second light source and is in a second state when the circuit energizes the second light source and does not energize the first light source, either, but not both, light sources being energized at any one time. A monitoring circuit monitors the integrity of the de-energized light source, determines when a de-energized light source has failed, and provides an indication that a de-energized light source has failed. The control circuit can, preferably, monitor the integrity of the de-energized light source by monitoring the voltage on the low side of the de-energized light source and the energized light source. Preferably, the monitoring circuit determines that the de-energized light source has failed when the voltage on the low side of each light source has dropped below a predetermined level.

The present invention provides a further circuit adapted to control the operation of at least two sources of visible light. The circuit includes a control circuit for receiving electrical energizing power suitable for igniting the light sources and selectively energizing the de-energizing the light sources. The control circuit is in a first state when the circuit energizes a first light source and does not energize a second light source and is in a second state when the circuit energizes the second light source and does not energize the first light source, either, but not both, the light sources being energized at any one time. A monitoring circuit is provided for monitoring the integrity of the energized light source, determining when the energized light source has failed, and causing the circuit to de-energize the energized light source and energize the de-energized light source when an energized light source fails. Preferably, the monitoring circuit monitors the integrity of the energized light source by monitoring the level of illumination provided by the energized light source and determining that the energized light source has failed when the illumination provided by the energized light source drops below a predetermined level. The circuit can, preferably, provides an indication that an energized light source has failed.

Therefore, a control circuit is provided which permits provision of a lighting control circuit having a controller mounted at a location remote from the light sources, from which operation of the light can be effected, which controller communicates with the light sources along only two electrical conductors. Further, additional control circuits are provided which permit provision of a lighting control system which reduces the length of time during which illumination is lost when an energized light source fails.

BRIEF DESCRIPTION OF THE DRAWINGS

The following detailed description of the preferred embodiments can be understood better if reference is made to the drawing, in which.

DETAILED DESCRIPTION OF THE PREFERRED EMBODIMENT

Figure 1:
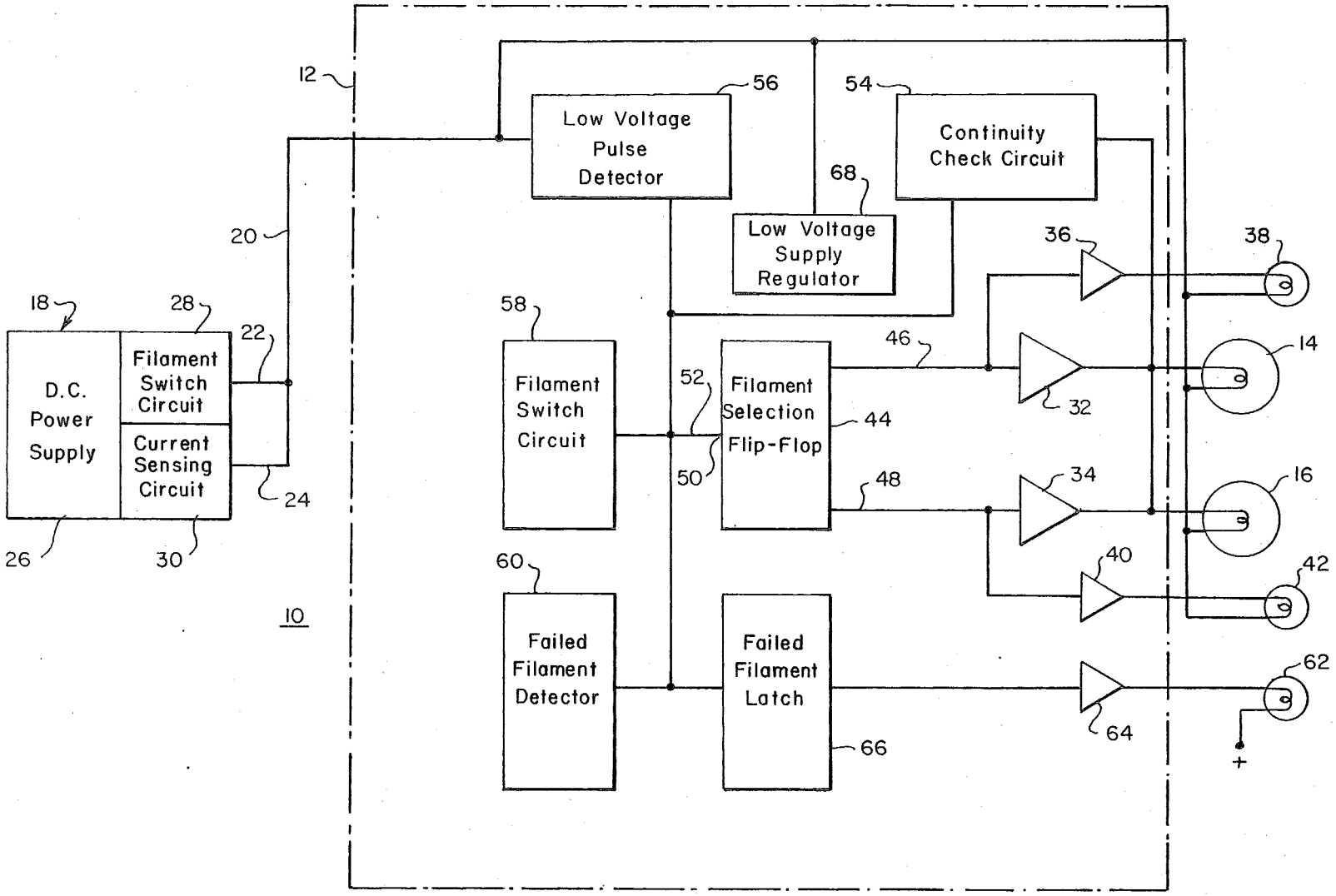
FIG. 1 is a block diagram representation of a lighting control system employing the preferred embodiment of the control circuit provided by the present invention.

FIG. 1 shows, in block diagram form, a lighting control system 10, which employs a control circuit 12 that is the preferred embodiment of the present invention. System 10 is of the type disclosed in an application for United States Letters Patent entitled System for Controlling the Operation of Electrically Powered Apparatus that was filed on the same day on which the present application was filed and which is owned by the assignee of the present application. System 10 is adapted to control the operation of a surgical light (not shown). The surgical light has more than one light source. The light sources should be of two types, which provide illumination of different patterns. For purposes of describing circuit 12, circuit 12 is presented below as it is adapted for use with a surgical light including light producing lamps, each of which includes two light producing filaments 14 and 16. Each filament 14 and 16 is so arranged in the lamp that it provides an illumination pattern of a type different from that provided by the remaining filament. In particular, filament 14 represents a filament employed by a lamp which provides a relatively small lighting pattern of high intensity, and filament 16 represents a filament employed by a lamp which provides a lighting pattern of relatively large size and low intensity. Filament 14 and 16 are not energized simultaneously. When either of filaments 14 and 16 is energized, the remaining filament is de-energized and is referred to as a "de-energized" or a "backup" filament. A surgical light of the type described above is described in U.S. Pat. No. 4,288,844.

Additionally, system 10 employs a controller 18 and a cable 20, which provides electrical communication between controller 18 and circuit 12. Controller 18 is located away from the sterile field of the operating room. Circuit 12 is contained by the head of the surgical light (not shown) which supports the lamps that provide illumination.

System 10 is capable of performing the following functions:

1. Continuously check the de-energized filament 14 or 16 and provide a visual indication at both the light head and controller 18 of the failure of a de-energized filament;
2. Determine the failure of an energized filament, provide a visual indication at both the light head and controller 18 of the failure of an engerized filament, de-energize the failed filament, and energize the de-energized filament;

3. Permit switching at the light head of energizing power from the energized filament to the de-energized filament;
4. Permit switching from controller 18 of energizing power from the energized filament to the de-energizing filament;
5. Provide a visual indication at the light head that both filaments 14 and 16 have failed; and
6. Provide a visual identification at the light head of the filament that is energized.

Cable 20 includes a pair of electrical conductors 22 and 24 that carry electrical information between controller 18 and circuit 12.

Controller 18 includes a conventional regulated DC power supply 26, filament switch circuit 28, and current sensing circuit 30. Power supply 26 applies energizing power, which is suitable for energizing filaments 14 and 16, in the form of DC voltage, to circuit 12 along lines 22 and 24. Further, circuit 12 converts the energizing power to +15 volts DC which is used as control power and to energize the indicator lamps of circuit 12. Filament switch circuit 28 includes conventional circuitry, such as a two position switch, for selectively and manually causing a momentary interruption of the application of energizing power to circuit 12. Such a power interruption will be referred to hereinafter as a "low voltage pulse". The low voltage pulse is interpreted by circuit 12 as an instruction to switch energizing power from the energized filament to the de-energized filament. Current sensing circuit 30 detects the interruption in the current flowing between controller 18 and circuit 12 that is caused by the failure of filament 14 or 16, which circuit 30 interprets as an indication that a filament 14 or 16 has failed. Current sensing circuit 30 energizes an indicator light (not shown) located at controller 18 that indicates that a filament 14 or 16 of the light head has failed when it senses an interruption in the current flowing along cable 20. Current sensing circuit 30 can be any suitable known circuit.

Control circuit 12, the preferred embodiment of the present invention, includes a driver 32 which operates filament 14, a driver 34 which operates filament 16, an indicator driver 36 which operates indicator lamp 38, and an indicator driver 40 which operates indicator lamp 42. Filament selection flip-flop 44 determines to which filaments energizing power is applied by operating drivers 32, 34, 36 and 40. Filament selection flip-flop 44 produces two signals, S and L, along lines 46 and 48, each of which can assume a high condition, or a logical "1" state, and a low condition, or a logical "0" state. Signal S is applied to both filament 14 and indicator 38, and signal L is applied to both filament 16 and indicator 42. Filament 14 and indicator 38 are energized or de-energized together and filament 16 and indicator 42 are energized or de-energized together by flip-flop 44. Therefore, an ignited indicator 38 indicates that filament 14 is energized, and an ignited indicator 42 indicates that filament 16 is energized. Signals S and L never assume the same logical state. Accordingly, either indicator 38 and filament 14, or indicator 42 and filament 16 are energized at the same time. Each time flip-flop 44 receives a switch signal, for example a positive pulse exceeding a predetermined threshold, at its input 50 along line 52, the outputs S and L of flip-flop 44 change their states to switch energizing power from the energized filament 14 or 16 to the de-energized filament. Each of continuity check circuit 54, low voltage pulse detector 56, filament switch circuit 58, and failed filament detector 60 are adapted, under predetermined conditions, to apply a positive pulse to input 50 of flip-flop 44 along line 52 to change the states of its outputs S and L.

Continuity check circuit 54 energizes failed filament indicator 62, which is located at the light head, if a de-energized filament fails. Also, when a de-energized filament fails, continuity check circuit 54 applies a positive pulse to flip-flop 44 to cause flip-flop 44 to energize the failed filament, which interrupts the current flowing between controller 18 and circuit 12. The current interruption is detected by current sensing circuit 30 at controller 18 and sensing circuit 30 energizes the indicator lamp located at controller 18 that indicates the existence of a failed filament at the light head. Shortly after continuity check circuit 54 causes the failed filament to be energized, failed filament detector 60, which is described in detail below, detects that a failed filament 14 or 16 is energized and applies a positive pulse to flip-flop 44 to cause flip-flop 44 to de-energize the failed filament and energize the remaining operative filament. Further, continuity check circuit 54 latches on failed filament driver 64 to ensure that failed filament indicator 62 remains energized unless power is removed from circuit 12 and the failed filament is replaced.

Failed filament detector 60 applies a positive pulse to filament selection flip-flop 44 to de-energize an energized filament 14 or 16 that has failed and to energize the de-energized filament. Also, when failed filament detector 60 senses a failed energized filament, it causes failed filament latch 66 to latch on failed filament driver 64 to ensure that failed filament indicator 62 remains energized unless power is removed from circuit 12 and the failed filament is replaced. Failure of an energized filament 14 or 16 interrupts the flow of current between controller 18 and circuit 12. The current interruption is sensed by current sensing circuit 30 which energizes the failed filament indicator located at controller 18.

Filament switch circuit 58 can be used to manually apply, at the light head, a positive pulse to the input 50 of flip-flop 44 to cause flip-flop 44 to change the state of its outputs S and L and to switch energizing power from the energized filament to the de-energized filament.

Low voltage pulse detector 56 senses the transmission of a low voltage pulse from controller 18 to circuit 12 and, in response thereto, applies a positive pulse to input 50 of filament selection flip-flop 44, which switches energizing power from the energized filament to the de-energized filament.

Low voltage supply regulator 68 provides positive 15 volt control voltage for circuit 12 at all times during operation of the system, and provides energizing power for indicators 38, 42, and 62.

Figure 2A:
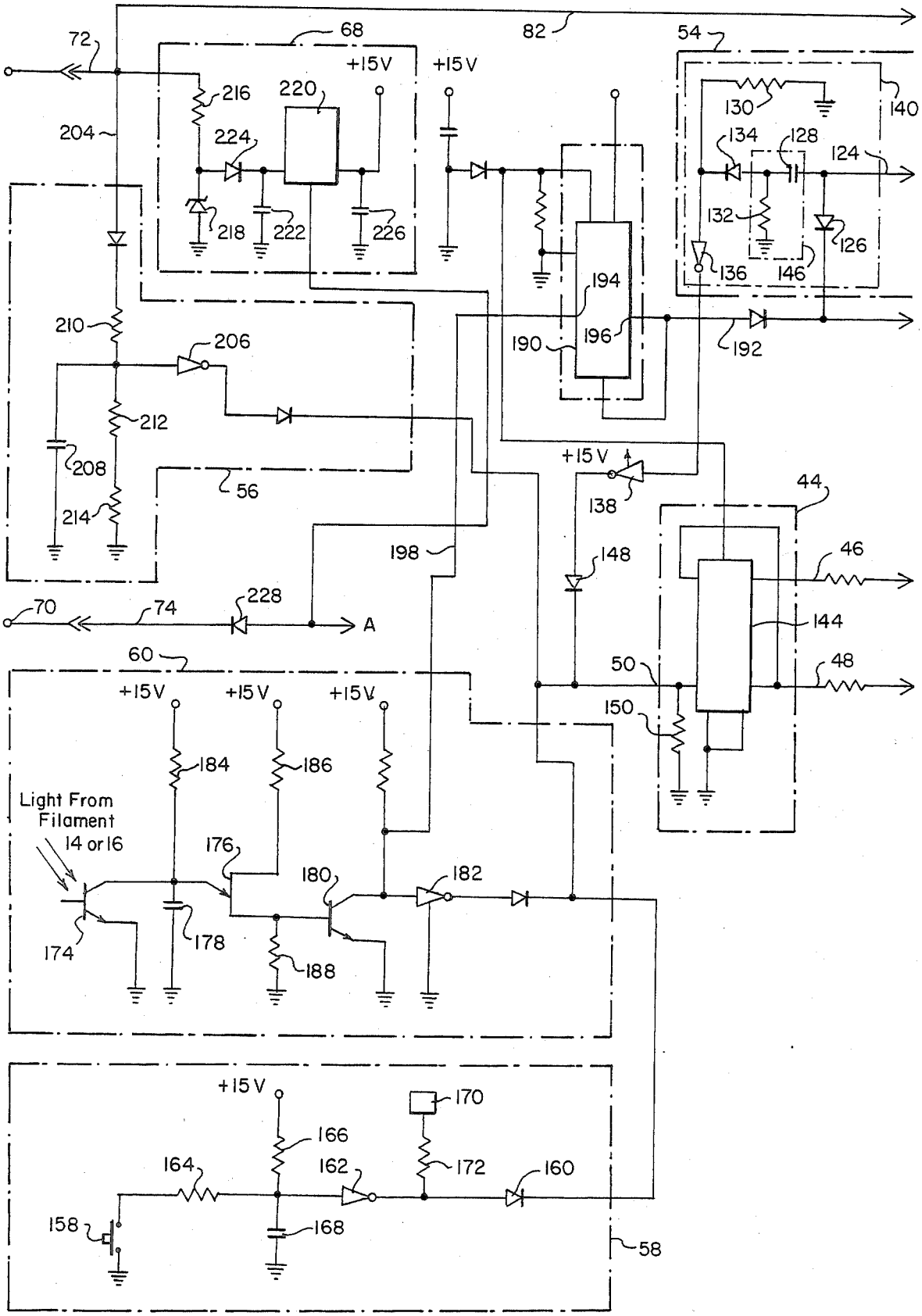
FIGS. 2*a* and 2*b* are schematic representations of a circuit that can be used to implement the block diagram of the control circuit shown in FIG. 1.
Figure 2B:
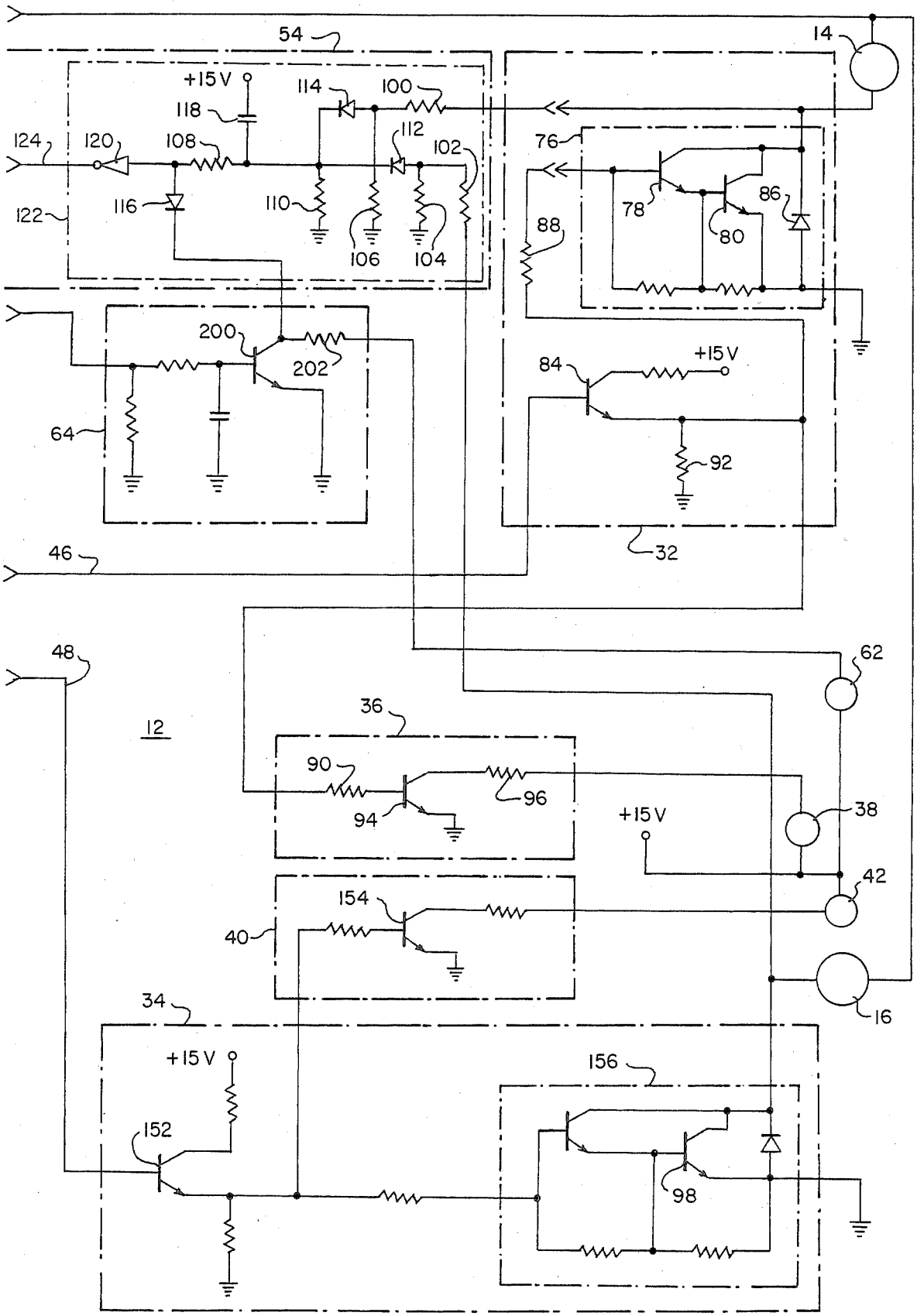

FIGS. 2*a* and 2*b* show the details of a circuit which is particulary suitable for implementing control circuit 12 shown in FIG. 1. Controller 18 applies power to circuit 12 at terminals 68 and 70. Line 72 is high and line 74 is circuit ground.

Filament drive circuit 32 includes a Darlington pair switching circuit 76 having a pair of transistors 78 and 80 which are operated in their switching modes. When transistor 78 is switched on, transistor 80 is switched on and energizing power from lines 72 and 82 is applied to filament 14. When transistor 78 is turned off, transistor 80 is turned off and energizing power from lines 72 and 82 is removed from filament 14 to extinguish it. Transistor 84 controls the switching of transistor pair 76. Transistor 84 is operated in its switching mode. When transistor 84 is turned on, transistor pair 76 is turned on and energizing power is applied to filament 14. When transistor 84 is turned off, transistor pair 76 is turned off and filament 14 is disconnected from energizing power. Diode 86 provides protection for transistor 80. Resistor 88 and resistor 90, which is a part of driver 36 described below, limit the current flowing through transistor 84 to an acceptable level. Resistor 92 establishes the proper triggering voltage for transistor 84 and transistor pair 76.

The operation of driver 36 also is controlled by transistor 84. Transistor 94 operates in its switching mode. When transistor 94 is turned on, indicator 38 is connected to positive 15 volt power, which is produced by low voltage supply regulator 68, through transistor 94 and resistor 96. When transistor 94 is turned off, indicator 38 is disconnected from low voltage supply 68. Resistor 90 and resistor 88, identified above, limit the current flowing through transistor 84. The resistances of resistors 88 and 90 are different from each other due to the different levels of base current required for operation of transistors 94 and 78. When transistor 84 of driver 32 is turned on, transistor 94 is turned on and indicator 38 is energized. When transistor 84 is turned off, transistor 94 is turned off and indicator 38 is de-energized.

The elements constituting filament driver 34 and driver 40, and the arrangement and functioning of those elements are identical to those of drivers 32 and 36, respectively. Therefore, further description of those circuits is not provided.

Continuity check circuit 54 detects the existence of a failed de-energized filament 14 or 16, provides an indication to controller 18 that a de-energized filament has failed, energizes indicator 62 to indicate that a filament has failed and latches on indicator driver 64 to ensure that indicator 62 will remain energized unless power is removed from circuit 12 and the failed filament is replaced. Continuity check circuit 54 detects a failed filament by monitoring the voltage across the collector of each of transistor 80 and transistor 98 of driver 34. If the voltage across both collectors falls below a minimum level, then, at least, the de-energized filament 14 or 16 has failed.

Resistors 100, 102, 104, 106, 108 and 110, diodes 112, 114 and 116, capacitor 118, and inverter 120, constitute a NOR gate 122, which produces a logical "1", or high, state on line 124 when a failed de-energized filament 14 or 16 is detected. Resistors 100, 102, 104 and 106 form voltage dividers which reduce the voltage applied to inverter 120 to its rated voltage. Capacitor 118 and resistors 108 and 110 form a time delay circuit which prevents circuit 54 from interpreting a low voltage across both transistors 80 and 98 as a failed de-energized filament unless the length of time during which the absence of voltage persists exceeds a predetermined minimum. Accordingly, a momentary low voltage condition at the collectors of both transistors 80 and 98, which, for example, occurs when energizing power is switched purposely from one of filaments 14 or 16 to the remaining filament, will not cause circuit 54 to falsely conclude that there is a de-energized filament failure. Accordingly, inverter 120 produces a logical "1" only if the collector voltages of both transistors 80 and 98 fall below the predetermined minimum level for a period of time that exceeds the minimum duration set by capacitor 118 and resistors 108 and 110. The function of diode 126 will be described below in the description of failed filament indicator driver 64.

Capacitor 128, resistors 130 and 132, diode 134, inverter 136, and inverter 138 form a monostable multivibrator 140, which applies a positive pulse to input 142 of flip-flop 144 of selection flip-flop 44 when a failed de-energized filament is detected. Each of inverters 136 and 138 constitute a Schmitt trigger. Capacitor 128 and resistor 132 form a differentiator 146 which produces a short positive pulse each time the output of inverter 120 changes from a logical "0" state to a logical "1" state. Diode 134 ensures that only positive pulses are differentiated by differentiator 146. Inverter 136 shapes and inverts the output of differentiator 146 when the output of differentiator 146 exceeds a predetermined threshold relative to a reference voltage established by resistor 130. Because the shaped pulse produced by inverter 136 is negative, inverter 138 is provided to apply a positive pulse to input 142 of flip-flop 144. Diode 148 prevents signals which are fed to input 142 of flip-flop 144 by circuits shown in FIG. *2a* from being reflected back into continuity check circuit 54.

Filament selection flip-flop 44 switches energizing power from one of pairs (i) filament 14 and indicator 38, and (ii) filament 16 and indicator 42 to the remaining pair. Filament selection flip-flop 44 includes flip-flop 144 and resistor 150. Each time clock input 142 of flip-flop 144 receives a positive pulse, outputs S and L on lines 46 and 48 change their logical states, that is, they change from a high, or "1", state to a low, or "0", state or from a low state to a high state. When output 48 is high, transistor 152 is turned on and, accordingly, transistor 154 and Darlington transistor pair 156 are turned on and filament 16 and indicator 42 are energized. When output 46 is high, transistor 84 and Darlington transistor pair 76 are turned on to energize filaments 14 and indicator lamp 38. Signals S and L never assume the same state. Therefore, filaments 14 and 16 are never energized simultaneously and indicators 38 and 42 are never energized simultaneously.

Filament switch circuit 58 permits manual switching of energizing power from one of filament 14 or 16 to the remaining filament. A push button switch 158 is connected between the input 50 of filament selection flip-flop 44 and circuit ground through diode 160, Schmitt trigger inverter 162, and resistor 164. The filament which is energized is changed each time switch 158 is actuated. Resistors 164 and 166 form a voltage divider at the input to inverter 162. Resistors 164 and 166 are so sized that when switch 158 is closed, the input to inverter 162 is a logical "0", since the voltage dropped across resistor 164 is lower than the threshold voltage of inverter 162, and inverter 162 produces a logical "1". When switch 158 is opened, an open circuit is introduced between resistor 164 and circuit ground, capacitor 168 becomes fully charged, and the input to inverter 162 rises above its threshold, and inverter 162 produces a logical "0". When inverter 162 produces a logical "1", a positive pulse is applied to input 142 of flip-flop 144, which causes outputs S and L on lines 46 and 48 to change states to switch energizing power from the filament 14 or 16 which was energized to the remaining filament. Block 170 represents a test point, which is current limited through resistor 172. If the voltage reading at point 170 remains high during operation of circuit 12, it can be assumed that filament switch circuit 58 has failed.

Failed filament detector 60 detects the failure of an energized filament, energizes failed filament indicator 62, switches energizing power from the failed filament 14 or 16 to the remaining de-energized filament, and ensures that indicator 62 remains energized unless power is removed from circuit 12 and the failed filament is replaced. Transistor 174 is a photosensitive transistor. When either filament 14 or filament 16 is producing proper illumination, transistor 174 receives light sufficient to maintain it on and the input to unijunction transistor 176 is, essentially, connected to circuit ground through transistor 174. If an energized filament 14 or 16 fails, transistor 174 receives insufficient light to remain on and, therefore, switches off, and capacitor 178 begins to charge. The input to transistor 176 rises to a level sufficient to turn on transistor 176 and transistor 176 turns on until capacitor 178 discharges to a level that is insufficient to maintain transistor 176 on, all of which results in the application of a positive pulse to the base of transistor 180. When transistor 176 turns on, the input to transistor 180 goes from, essentially, ground to a value sufficient to turn on transistor 180. Accordingly, transistor 180 receives a positive pulse from transistor 176 and creates a negative pulse, which is inverted and shaped by inverter 182 and applied to input 142 of flip-flop 144 to switch energizing power from the failed filament 14 or 16 to the remaining filament.

If the backup filament also has failed, detector 60 begins to oscillate and causes indicators 38 and 42 to flash. When the energized filament fails, the light input to transistor 174 falls below the threshold level needed to maintain it on, transistor 174 opens and capacitor 178 begins to charge at the rate determined by the size of resistor 184. When the voltage drop across capacitor 178 reaches the trigger threshold of transistor 176, which is determined by the sizes of resistors 186 and 188, transistor 176 turns on and causes a positive pulse to be applied to input 142 of flip-flop 144, as is described generally above. However, when transistor 176 is on, capacitor 178 discharges through transistor 176 at a much higher rate than that at which it is charged by the positive 15 volt supply, to which it is connected, if the resistance values of resistors 184, 186, and 188 are chosen properly. Accordingly, if the remaining filament 14 or 16 is not ignited when flip-flop 144 receives a pulse at input 142 from inverter 182—for instance, when the remaining filament also has failed—the voltage across capacitor 178 will drop to a level that is insufficient to maintain transistor 176 on, and transistor 176 will turn off. At that point, the positive 15 volt supply again begins to charge capacitor 178 until the voltage across it reaches the threshold of transistor 176 and transistor 176 again turns on. When both filaments 14 and 16 are failed, transistor 176 will be turned on and off by capacitor 178 repeatedly, thereby repeatedly applying positive pulses to input 142 of flip-flop 144—and, therefore, switch energizing power between filaments 14 and 16 repeatedly—until transistor 174 receives light at a level greater than its threshold level, which would short capacitor 178 and cause it to become discharged. Indicators 38 and 42 will flash, alternately with respect to each other, at one half the rate at which positive pulses are applied to flip-flop 144 by failed filament detector 60. The flashing indicators indicate that both filaments 14 and 16 have failed. The relative sizes of resistors 184, 186, and 188 should be chosen to ensure that an operable backup light can produce light sufficient to turn on transistor 174 before detector 60 begins oscillating. Suitable sizes for resistors 184, 186, and 188 are shown in FIG. 2*a*.

Failed filament latch 66 ensures that once failed filament indicator 62 is energized, it remains energized until power is removed from circuit 12 and each failed filament is replaced with an operative filament. When circuit 12 is energized, flip-flop 190 produces a logical "0" on line 192. The first time the clock input 194 of flip-flop 190 receives a positive pulse, output 196 of flip-flop 194 assumes a logical "1" state. Any additional positive pulses received by input 194 have no effect on the output of flip-flop 190 at 196. Input 194 of flip-flop 190 receives a positive pulse from the failed filament detector 60 along line 198 when an energized filament fails. Output 196 assumes a logical "1" state, which provides a positive input to failed filament indicator driver 64. Transistor 200 is turned on, which causes the positive 15 volt supply to be applied to indicator 62 through resistor 202 and transistor 200. Because output 196 is latched in its logical "1" state, failed filament indicator 62 will remain energized unless energizing power is removed from circuit 12 and the failed filament 14 or 16 is replaced by an operative filament.

Further, indicator 62 is energized by filament continuity check circuit 54 when a de-energized filament 14 or 16 fails. When a de-energized filament 14 or 16 fails, inverter 120 applies a positive signal to the base of transistor 200 through diode 126, thus turning it on and energizing failed filament indicator 62. Further, because the input to inverter 120 is low, the collector of transistor 200 remains low, thus ensuring that indicator 62 will remain energized unless energizing power is removed from circuit 12 and the failed filament is replaced. Whether indicator 62 was energized by failed filament detector 60 because an energized filament 14 or 16 failed, or by continuity check circuit 54 because a de-energized filament failed, indicator 62 will not remain de-energized after energizing power has been removed from circuit 12 and subsequently restored unless the failed filament is replaced by an operative filament. For example, if filament 16 fails and circuit 12 is de-energized and then subsequently energized without replacing filament 16, circuit 12 will attempt to either energize failed filament 16, or it will energize filament 14, depending on which filament circuit 12 normally energizes when it initially receives power from controller 18. In the former case, failed filament detector 60 causes indicator 62 to be energized. In the latter case, continuity check circuit 54 energizes indicator 62.

Low voltage pulse detector 56 receives filament energizing power on line 204. When low voltage pulse detector 56 receives a low voltage pulse, it causes the removal of energizing power from the energized filament 14 or 16 and application of energizing power to the remaining filament. Inverter 206 is a Schmitt trigger which produces a positive pulse when its input falls below a predetermined threshold. Accordingly, when low voltage pulse detector 56 receives a low voltage pulse from controller 18, the input to invertor 206 momentarily falls below its threshold and inverter 206 applies a positive pulse to clock input 142 of filament selection flip-flop 144 to remove energizing power from the energized filament 14 or 16 and apply energizing power to the remaining filament. As is described above, the low voltage pulse can be created by a push button (not shown) located at controller 18, which momentarily interrupts the energizing power when it is actuated. The push button of controller 18 creates a low voltage pulse of a duration that is longer than those of the voltage gaps inherent in the 60 Hz full wave rectified supply voltage constituting the energizing power, and other short duration transients. The duration of the low voltage pulse should not be so long that a noticeable absence of illumination is created. Capacitor 208 and resistors 210, 212, and 214 are provided and sized to prevent inverter 206 from applying positive pulses to filament selection flip-flop 44 upon the occurrence of such transients. When energizing power is available, capacitor 208 is fully charged. Upon occurrence of a voltage gap, due either to low voltage pulse or transients, capacitor 208 begins to discharge through resistors 212 and 214. If the gap is due to low voltage pulse, the voltage across capacitor 208 falls below the threshold of inverter 206, and inverter 206 produces a positive pulse which is applied to filament selection flip-flop 44. If the voltage gap is due to a short duration transient, capacitor 208 cannot discharge to a level sufficiently low to cause inverter 206 to produce a positive pulse before the gap ends and energizing power returns, and a positive pulse is not applied to filament selection flip-flop 44. At the end of the low voltage pulse, energizing power returns and capacitor 208 begins to charge. When the voltage across capacitor 208 exceeds the threshold of inverter 206, the output of inverter 206 returns to a logical "0" state.

Low voltage regulator 68 provides positive 15 volt control voltage and energizing power for indicator lamps 38, 42, and 62. Resistor 216 limits the current through low voltage regulator 220 and is sized to limit the current through diode 218. Diode 218 limits the voltage that can be applied to the input of voltage regulator 220. Capacitor 222 is fully charged during normal operation and ensures that the input to regulator 220 is available upon occurrence of negative voltage on line 72. Diode 224 prevents capacitor 222 from discharging through terminal 68 during occurrence of a negative voltage pulse thereon. Capacitor 226 limits the ripple on the ouput of regulator 220. Regular 220 includes a heat sink.

Diode 228 is provided to ensure that circuit 12 is not damaged if positive voltage is inadvertently applied to terminal 70. Diode 228 is mounted to a heat sink to prevent thermal damage from occurring to it during normal operation of circuit 12.

Suitable sizes for the more important components of circuit 12 and identification of some suitable components for use in circuit 12 are shown in FIGS. *2a* and *2b* and the following table.

| Ref No. | Component | Value or Part No.* |
|---|---|---|
| 76 | Switching Ckt | MJ11032 |
| 84 | Transistor | 2N3904 |
| 88 | Resistor | 1K |
| 90 | Resistor | 4.7K |
| 92 | Resistor | 10K |
| 94 | Transistor | 2N3904 |
| 96 | Resistor | 680 |
| 100 | Resistor | 10K |
| 102 | Resistor | 10K |
| 104 | Resistor | 12K |
| 106 | Resistor | 12K |
| 108 | Resistor | 120K |
| 110 | Resistor | 27K |
| 118 | Capacitor | 47 (16 v) |
| 120 | Invertor | 4584 |
| 128 | Capacitor | 1 |
| 130 | Resistor | 22K |

-continued

| Ref No. | Component | Value or Part No.* |
|---|---|---|
| 132 | Resistor | 22K |
| 144 | Flip-flop | 4013 |
| 150 | Resistor | 10K |
| 152 | Transistor | 2N3904 |
| 154 | Transistor | 2N3904 |
| 156 | Switching Ckt | MJ11032 |
| 162 | Invertor | 4584 |
| 164 | Resistor | 4.7K |
| 166 | Resistor | 18K |
| 168 | Capacitor | .22 |
| 172 | Resistor | 10K |
| 174 | Transistor | MRD 3055 |
| 176 | Transistor | 2N4647 |
| 178 | Capacitor | 2 (16 v) |
| 180 | Transistor | 2N3904 |
| 182 | Inverter | 4584 |
| 184 | Resistor | 120K |
| 186 | Resistor | 680 |
| 188 | Resistor | 150 |
| 190 | Flip-flop | 4013 |
| 200 | Transistor | 2N3904 |
| 202 | Resistor | 680 |
| 206 | Invertor | 4584 |
| 208 | Capacitor | 3.3 (35 v) |
| 210 | Resistor | 12K |
| 212 | Resistor | 10K |
| 214 | Resistor | 1K |
| 216 | Resistor | 200 (5 W) |
| 218 | Diode | IN5359A |
| 220 | Heat sink | 7815 |
| 222 | Capacitor | 1000 (50 v) |
| 224 | Diode | IN4002 |
| 226 | Capacitor | 22 (35 v) |
| 228 | Diode | IN 1200 RA |

*All resistor values are in ohms and all capacitor values in microfarads.

What is claimed is:

1. A circuit adapted to control the operation of first and second sources of visible light each producing a distinct pattern, said circuit comprising:

a first switch associated with said first light source and a second switch associated with said second light source, each of said switches adapted to operate in first and second states, each of said switches applying energizing power received by it to said associated light source when in its first state and preventing the application of energizing power to said associated light source when in its second state, each of said switches defining an input adapted to receive control signals, each of said switches assuming its first state when a control signal of a first type is applied to said input and assuming its second state when a control signal of a second type is applied to said input;

control signal generating means defining a first output which is operably associated with said first switch and a second output which is operably associated with said second switch, said control signal generating means for generating said control signals at said outputs for application to said switches, said control signal generating means being in a first state when a control signal of first type is available at said first output and a control signal of said second type is available at said second output, said control signal generating means being in a second state when a control signal of said first type is available at said second output and a control signal of said second type is available at said first output, said control signal generating means defining an input, said control signal generating means changing states each time a pulse signal is applied to said input thereof; and means for applying said pulse signals to said input of said control signal generating means each time the level of said energizing power drops below a predetermined level for a predetermined period of time.

2. A circuit for controlling the operation of an electric light having means for creating first and second distinct illumination patterns, said circuit comprising:

a switch assembly adapted to operate in first and second states, said switch assembly for connecting the means for creating first and second distinct illumination patterns to a source of electrical power to create the first illumination pattern when said switch assembly is in its first state and to create the second illumination pattern when said switch assembly is in its second state, said switch assembly defining an input adapted to receive control signals, said switch assembly assuming its first state when a control signal of a first type is applied to said input and assuming its second state when a control signal of a second type is applied to said input;

control signal generating means defining an input and an output, said control signal generating means generating said control signals at said output for application to said switch assembly, said control signal generating means changing the type of said control signal generated at said output each time a pulse signal is applied to said input thereof; and means for receiving said energizing power and applying said pulse signals to said input of said control signal generating means each time the level of said energizing power drops below a predetermined level for a predetermined period of time.

3. The circuit of claim 2 wherein said control signal generating means includes a flip-flop.

4. The circuit of claim 2 wherein said means for receiving said energizing power includes a pulse detector.

* * * * *

UNITED STATES PATENT AND TRADEMARK OFFICE

CERTIFICATE OF CORRECTION

PATENT NO. : 4,734,625

DATED : March 29, 1988

INVENTOR(S) : Michael Geanous and Richard G. Confer

It is certified that error appears in the above-identified patent and that said Letters Patent is hereby corrected as shown below:

Col. 3, line 42, delete "the" (second occurrence), and substitute therefor --and--.

Signed and Sealed this

Twenty-third Day of August, 1988

*Attest:*

DONALD J. QUIGG

*Attesting Officer*

*Commissioner of Patents and Trademarks*